United States Patent [19]

Holman

[11] Patent Number: 4,574,992

[45] Date of Patent: Mar. 11, 1986

[54] CLINCHING TYPE STAPLER

[75] Inventor: Alfred D. Holman, Villa Park, Ill.

[73] Assignee: Duo-Fast Corporation, Franklin Park, Ill.

[21] Appl. No.: 643,853

[22] Filed: Aug. 24, 1984

[51] Int. Cl.[4] ..... B25C 5/04

[52] U.S. Cl. ..... 227/83; 227/130

[58] Field of Search ..... 227/83, 130

[56] References Cited

U.S. PATENT DOCUMENTS

| | | | |
|---|---|---|---|
| 2,237,438 | 4/1941 | James | 227/83 |
| 3,152,335 | 10/1964 | Wandel et al. | 227/83 |
| 4,013,206 | 3/1977 | Lemos | 227/83 |

*Primary Examiner*—Paul A. Bell

*Attorney, Agent, or Firm*—Mason, Kolehmainen, Rathburn & Wyss

[57] ABSTRACT

A resilient anvil for clinching staples driven through a drive track is adjustably mounted on the stapler to permit compensation for wear and to otherwise control the curl or clinch applied to the driven staple. Overlapping or partially aligned openings in the anvil and a fixed adjusting or locating plate provide camming edges or surfaces adapted to be engaged by, for example, an inserted screwdriver bit. When the bit is turned, the position of the anvil relative to the drive track is varied. Threaded fasteners lock the anvil and plate in the adjusted relative positions on the stapler.

5 Claims, 4 Drawing Figures

CLINCHING TYPE STAPLER

BACKGROUND OF THE INVENTION

A. Field of the Invention

The present invention relates to a clinching type stapler and, more particularly, to a stapler having an anvil structure for clinching staples that is not only economically fabricated and easily adjusted, but is also compact and integrally formed to permit stapling in closed or confined areas.

B. Description of the Background Art

There are a number of applications in which staplers are most efficiently used to join material by diverging the legs of a stable that is driven to provide an outwardly clinched staple. U.S. Pat. Nos. 2,420,258 and 3,417,908 disclose outwardly of clinching staplers in which an anvil normally disposed beneath the legs of a staple engages these legs of the staple as driven to impart an outwardly directed curl or clinch to the legs. These anvils are formed of resilient material and are deflected or cammed out of a staple raceway or drive track by engagement with a driver blade or the crown of the staple, thereby permitting the discharge of the driven staple. In other outwardly clinching staplers such as that shown in U.S. Pat. No. 3,807,619, the anvil structure is a pivotally mounted, rigid member engaged by a biasing spring and movable into and out of an effective position as the driver blade is reciprocated within the drive track.

These staplers provide effective clinching, but the degree of curl or clinch achieved is directly dependent on forming the staple legs as they engage the anvil and are forced between the anvil surfaces and the adjacent surfaces of a nosepiece defining the drive track. This metal-to-metal engagement results in wear on the engaged anvil surfaces and the nosepiece structures with the result that the degree of curl or clinch attained changes after a number of staples have been driven. In applications in which large numbers of staples are driven daily, the effective life of the tool is frequently less than would be desired. In addition, the springs used with the rigid anvil structure have a shorter useful life than would be desired.

The anvil-nosepiece spacing necessary for proper clinching can be restored by adjusting the relative positions of the anvil-nosepiece structures as wear occurs. U.S. Pat. No. 2,237,438 discloses a clinching stapler in which a screw interposed between a stapler housing and a movable rigid anvil support permits adjustment of a rigid anvil relative to a nosepiece. U.S. Pat. No. 3,152,335 discloses a cam arrangement for controlling the gap between a rigid anvil and a nosepiece structure in an outward clinch stapler. However, both of these arrangements are somewhat difficult to adjust quickly under the time constraints of a high production operation. In addition, one of these units requires so much space that the use of the stapler in confined areas is substantially restricted.

SUMMARY OF THE INVENTION

Accordingly, one object of the present invention is to provide a new and improved clinching stapler.

Another object is to provide a stapler with a new and improved means for adjusting the position of an anvil relative to a nosepiece or drive track within the nosepiece.

Another object is to provide a clinching stapler in which the relative positions of an anvil and a nosepiece can be easily and quickly set without requiring reassembly of the stapler.

A further object is to provide a resilient deflectable anvil for a clinching stapler which is easily and quickly adjusted for wear or desired flare using an apertured plate carried on the nosepiece of the stapler.

Briefly, the present invention includes a staple driving tool with a housing having a nosepiece in which is formed a drive track reciprocably receiving a staple driving blade. The drive track is partially open on one side to receive a resilient anvil structure with outwardly and downwardly tapered surfaces disposed beneath the legs of a staple supplied to the drive track by a magazine. As a staple is driven, the free lower ends of the staple legs engage the surfaces and are displaced outwardly to provide an outwardly clinched staple. As the staple crown and driver blade reach the lower end of the drive track, the lower free end of the anvil structure is momentarily displaced from the drive track to permit the ejection of the driven staple.

The postion of the anvil can be adjusted in a direction parallel to the direction of movement of the driver to compensate, for example, for wear. To this end, an adjusting or locating plate mounted in a fixed position on the nosepiece overlies the upper free end of the anvil structure. The upper free end of the anvil and the adjusting plate each include oppositely extending and aligned cam openings adapted to receive, for example, the bit of a screwdriver. By turning the screwdriver bit within the openings, the position of the anvil relative to the drive track and the nosepiece is adjusted. Threaded fasteners passing through the plate and elongated openings in the upper free end of the anvil secure the anvil in its adjusted position.

BRIEF DESCRIPTION OF THE DRAWINGS

Many other objects and advantages of the present invention will become apparent from considering the following detailed description in conjunction with the drawings in which.

DETAILED DESCRIPTION OF THE PREFERRED EMBODIMENT

Figure 1:
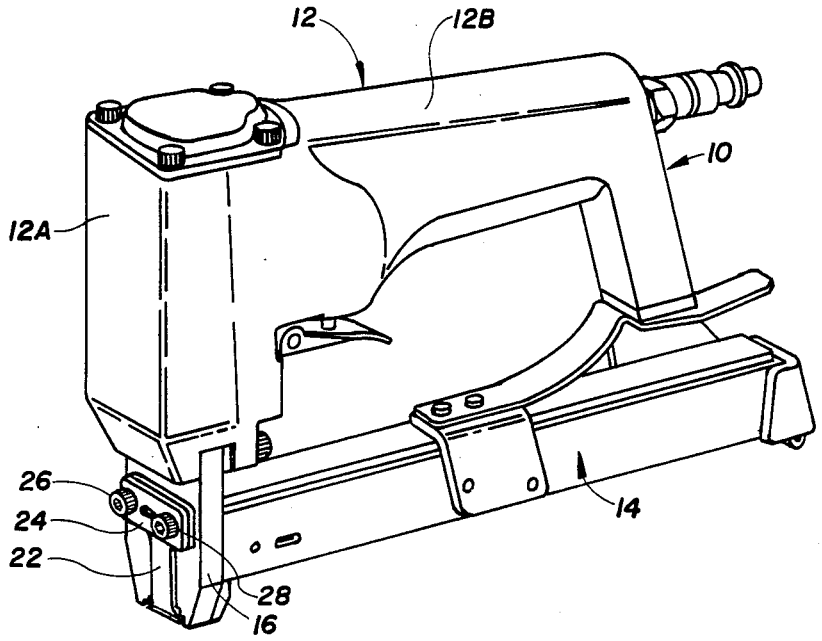
FIG. 1 is a perspective view of a pneumatic stapler including the improved outward clinching assembly embodying the present invention.
Figure 3:
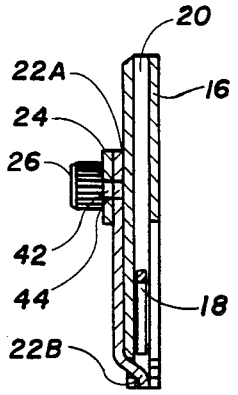
FIG. 3 is a sectional view taken along line 3—3 in FIG. 2.
Figure 4:
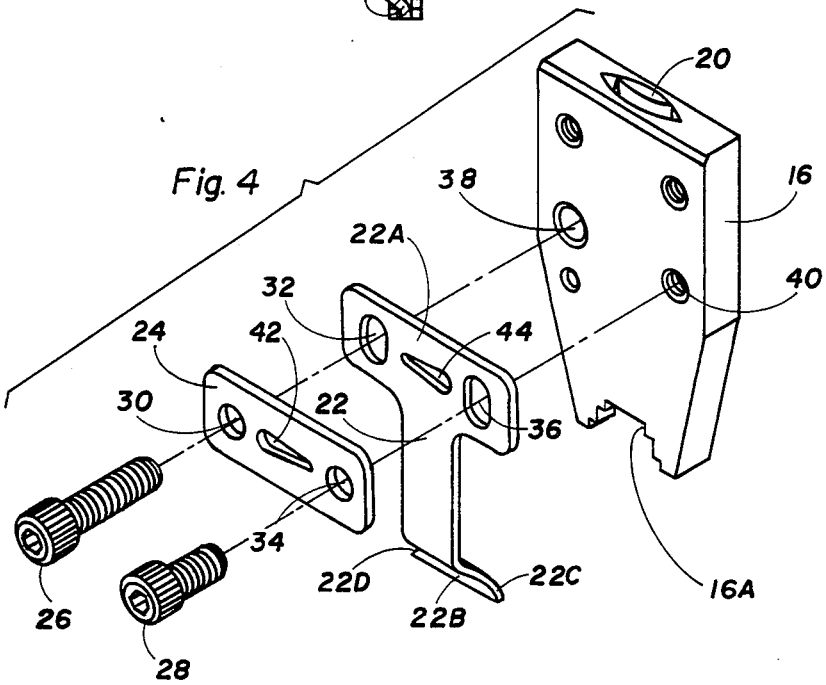
FIG. 4 is an exploded perspective view of the nosepiece and adjustable anvil assembly.

Referring now more specifically to the drawings, there is illustrated a pneumatic fastener driving tool indicated generally as 10 (FIG. 1) which embodies the present invention and which includes a housing indicated generally as 12 having a head portion 12A and a hollow handle portion 12B. A magazine assembly indicated generally as 14 is secured at its front end to a nosepiece structure or assembly 16 and serves to supply successive staples, such as a staple 18 (FIG. 3), to a raceway or drive track 20 in the nosepiece 16 to be driven by a driver blade, not shown. The driver blade is reciprocated within the drive track 20 by a piston-cylinder motor (not shown) contained in the head portion 12A. The nosepiece structure 16 is secured to the lower end of the housing portion 12A, and the rear portion of the magazine assembly 14 is carried on a depending portion of the handle 12B. The pneumatic fastener driving tool 10, as well as the magazine assembly 14 are conventional in construction and could be of the type shown and described in detail in U.S. Pat. Nos. 3,437,250 and 3,496,840.

To provide means for imparting a controlled outward clinch or curl to staples 18 driven through the drive track or raceway 20, there is provided an anvil structure 22 having a transversely extending upper end 22A secured to an outer wall of the nosepiece structure 16, and an inwardly inclined, free lower end portion 22B which projects through an opening 16A in the nosepiece structure 16 so as to enter the drive track 20. Two outwardly and downwardly inclined or cammed surfaces 22C and 22D on the free end portion 22B are disposed below the lower ends of the legs on the staple 18. The anvil 22 is formed in a generally flat plate-like configuration of resilient material.

The anvil 22 is mounted on a front wall surface of the nosepiece structure 16 by an adjusting or locating plate 24 and two threaded fasteners 26, 28. The threaded fasteners or machine screws 26, 28 pass thorugh aligned openings 30, 32 and 34, 36 in the adjusting plate 24 and the upper end 22A of the anvil 22. The screw 26 passes through a clearance hole 28 to a tapped hole in the housing 12. The screw 28 is received in a tapped opening 40 in the nosepiece structure 16. By tightening the machine screws 26, 28, the adjusting plate or locating means 22 clamps the interposed portion 22A against the front wall of the nosepiece structure 16 to hold the anvil 22 in its desired position on the nosepiece structure 16. The upper end portion 22A provides a locating and mounting means for the anvil 22.

Figure 2:
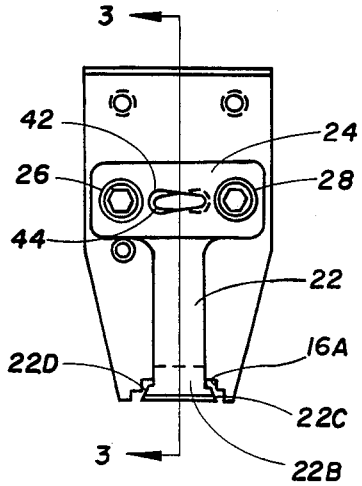
FIG. 2 is an elevational view of a nosepiece structure on which is adjustably mounted an outward clinch anvil assembly.

When staples 18 are driven downwardly (FIG. 3) through the raceway 20, the lower ends engage the cam surfaces 22C, 22D and are deflected outwardly through the area between these surfaces and the walls defining the opening 16A (FIG. 2) to pass through a workpiece (not shown), with an outwardly extending clinch or curl. As the crown of the staple 18 and the driver blade reach the lower end of the raceway 20, the inwardly inclined portion 22B is contacted by the staple crown and/or the driver blade, and the lower free end of the anvil 22 is cammed away from the drive track 20 to permit the discharge of the driven staple 18. As the driver blade is retracted, the inherent resiliency of the material forming the anvil 22 returns the lower anvil portion 22B to its proper position within the opening 16A in the nosepiece structure 16.

As a number of staples are driven, wear is occasioned on the surfaces 22C, 22D, and this wear causes the degree of curl or clinch imparted to the staple 18 to vary from that which is desired. The desired degree of clinch can be restored by adjusting the position of the anvil portion 22B within the opening 16A to compensate for the wear.

To provide for this adjustment, two generally tear-shaped openings 42, 44 are provided in the adjusting plate 24 and the upper free end 22A of the anvil 22, respectively. The openings 42, 44 overlie each other with the cam or adjusting surfaces defining these openings extending in opposite directions. When it is necessary to adjust the position of the anvil 22, the machine screws 26 and 28 are loosened, and a flat member, such as the bit of a screwdriver, is inserted within the openings 42, 44. When the screwdriver bit is turned, its edges bear against the inclined or cammed surfaces defining the openings 42, 44 and produce relative movement therebetween. The anvil 22 is moved vertically because the openings 32, 36 thereon are elongated in the direction parallel to the length of the raceway 20, whereas the openings 30, 34 maintain the adjusting or locating plate 24 in a fixed position relative to the nosepiece structure 16. When the surfaces 22C, 22D have been placed in a proper position relative to the surface defining the opening 16A, the machine screws 26, 28 are tightened to clamp the plate 24 against the portion 22A of the anvil 22 and thus lock the anvil in its desired position. This is very easily accomplished, using readily available tools, and without requiring any substantial disassembly of the tool 10.

This same adjustment can be used to control or change the degree of clinching or curl imparted to the staple 18 during driving. In this manner, the stapler 10 can be used to fasten different materials of varying thickness.

Although the present invention has been described with reference to one preferred embodiment thereof, it will be apparent that numerous other modifications and embodiments can be devised by those skilled in the art which will fall within the spirit and scope of the present invention.

What is claimed and sought to be secured by Letters Patent of the United States is:

1. In a stapling tool of the type having both a nose structure defining a track through which a staple with spaced legs is driven and an anvil structure movable into and out of the track to engage and impart controllable curl to the staple legs as the staple is driven, the improvement comprising a first anvil locating structure connected to the anvil structure and including a first opening, a second anvil locating structure disposed adjacent said first anvil locating structure and including a second opening, said first and second openings being at least partially aligned with each other so that an adjusting instrument can be inserted into said first and second openings for varying the relative positions of the first and second anvil locating structures so as to vary the position of said anvil structure relative to said track, and fastening means securing said first and second locating structures on the nose in different positions relative to each other.

2. The stapling tool set forth in claim 1 in which said first and second openings in said first and second anvil locating structures are defined by oppositely extending inclined edges providing cam surfaces for engagement with the adjusting instrument.

3. In a stapling tool of the type in which an anvil movable into and out of a drive track formed in a nosepiece engages and imparts controllable curl to spaced legs on a staple driven through the track, the improvement comprising an anvil structure including said anvil movably mounted on said nosepiece, said anvil structure having a first opening therein, a locating plate mounted in a fixed position on said nosepiece and disposed adjacent the anvil structure, said locating plate having a second opening at least partially aligned with said first opening to permit an adjusting instrument to enter said first and second openings and move the locating plate and anvil structure to different positions relative to each other, thereby to adjust the position of the anvil relative to the drive track, and fastening means to secure the locating plate and anvil structure on the nosepiece in said adjusted relative position.

4. The stapling tool set forth in claim 3 in which said anvil structure includes a plate-like portion containing said first opening, and in which said plate-like portion is interposed between said nosepiece and said locating plate.

5. The stapling tool set forth in claim 3 in which structures forming said first and second openings provide cam means engageable by said adjusting instrument to adjust the position of said anvil relative to said track.

* * * * *